US007322348B2

(12) United States Patent
Chen

(10) Patent No.: US 7,322,348 B2
(45) Date of Patent: Jan. 29, 2008

(54) ELECTRIC PAINTBALL FEED HOPPER FOR PAINTGUNS

(75) Inventor: I-Chun Chen, Sanchong (TW)

(73) Assignee: Speed Paintball Co., Ltd., Taipei County (TW)

( * ) Notice: Subject to any disclaimer, the term of this patent is extended or adjusted under 35 U.S.C. 154(b) by 247 days.

(21) Appl. No.: 11/263,931

(22) Filed: Nov. 2, 2005

(65) Prior Publication Data

US 2007/0101981 A1 May 10, 2007

(51) Int. Cl.
*F41B 11/02* (2006.01)

(52) U.S. Cl. ..... 124/51.1

(58) Field of Classification Search ..... 124/48, 124/49, 51.1, 73, 74
See application file for complete search history.

(56) References Cited

U.S. PATENT DOCUMENTS 5,954,042 A * 9/1999 Harvey ..... 124/51.1
6,109,252 A * 8/2000 Stevens ..... 124/51.1
6,327,953 B1 * 12/2001 Andresen ..... 89/33.17
6,981,493 B1 * 1/2006 Poteracke ..... 124/51.1

* cited by examiner

*Primary Examiner*—John A. Ricci
(74) *Attorney, Agent, or Firm*—Troxell Law Office, PLLC

(57) ABSTRACT

An electric paintball feed hopper for paintguns, characterized in having a hopper opening, which provides for loading paintballs, defined in a hopper, a fastening cover, which prevents the paintballs from falling out, is fitted to the hopper opening, and an oblique partition, which provides for sequencing of the paintballs, is further configured on an inner side of the fastening cover. Moreover, a motor-driven paintball feed mechanism and a guide mechanism, which provides for successively feeding the paintballs, are configured at a lower end of the oblique partition. After a round of paintballs is loaded into the hopper, the paintball feed mechanism and the guide mechanism enable sequencing of the paintballs loaded within the hopper and successive shifting into a barrel of a paintgun, thereby achieving uninterrupted shooting and providing an effect that closely simulates the firing of a real gun.

4 Claims, 8 Drawing Sheets

ELECTRIC PAINTBALL FEED HOPPER FOR PAINTGUNS

BACKGROUND OF THE INVENTION (a) Field of the Invention

The present invention relates to an electric paintball feed hopper for paintguns, and more particularly to a paintball feed hopper that functions through an oblique partition configured within the hopper together with a motor-driven paintball feed mechanism.

(b) Description of the Prior Art

A conventional paintgun hopper, as depicted in FIGS. 1 and 2, uses a paintball feed opening B1 of a barrel B to enable paintballs A2 loaded into a hopper chamber A1 to be fed in succession into a barrel bore B2 through a paintball feed passageway A3, thereby achieving an uninterrupted firing mechanism. However, when proceeding with a paintball shooting game, a hopper A disposed on top of the barrel B is not only unable to achieve an effect that closely simulates the firing of a real gun, moreover, weight of the round of paintballs A2 loaded within the hopper chamber A1 presses down on the paintball feed passageway A3, thereby resulting in a situation whereby the paintballs A2 become jammed.

Hence, the inventor of the present invention proposes to resolve and surmount existent technical difficulties to eliminate the aforementioned shortcomings of prior art.

SUMMARY OF THE INVENTION

The present invention provides an electric paintball feed hopper for paintguns, which primarily functions through an oblique partition configured within a hopper together with a motor-driven paintball feed mechanism. After a round of paintballs is loaded into the hopper, the internally disposed paintball feed mechanism and a guide mechanism enable sequencing of the paintballs loaded within the hopper and successive shifting into a barrel of the paintgun, thereby enabling uninterrupted shooting, and achieving an effect that closely simulates the firing of a real gun, which enhances user enjoyment.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
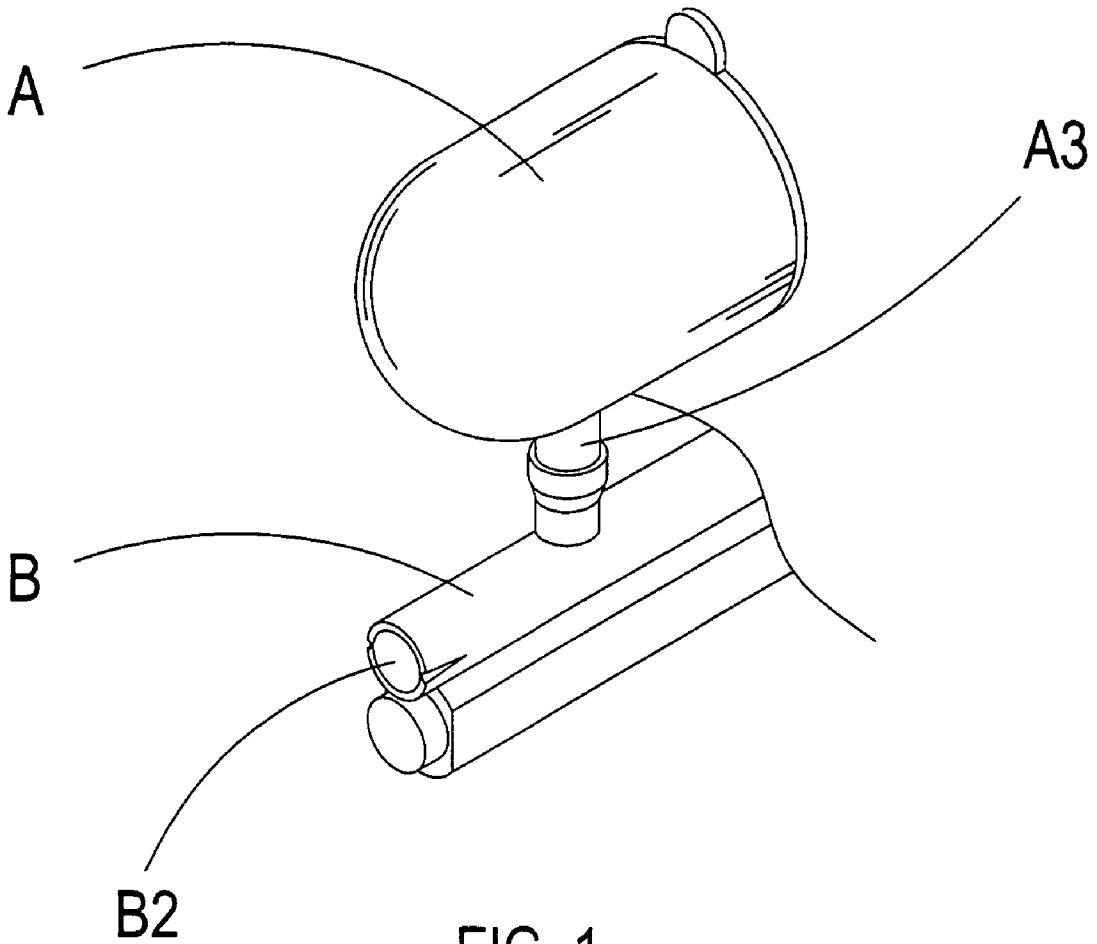
FIG. 1 Prior Art
FIG. 1 shows an elevational view of a conventional paintgun hopper.
Figure 2:
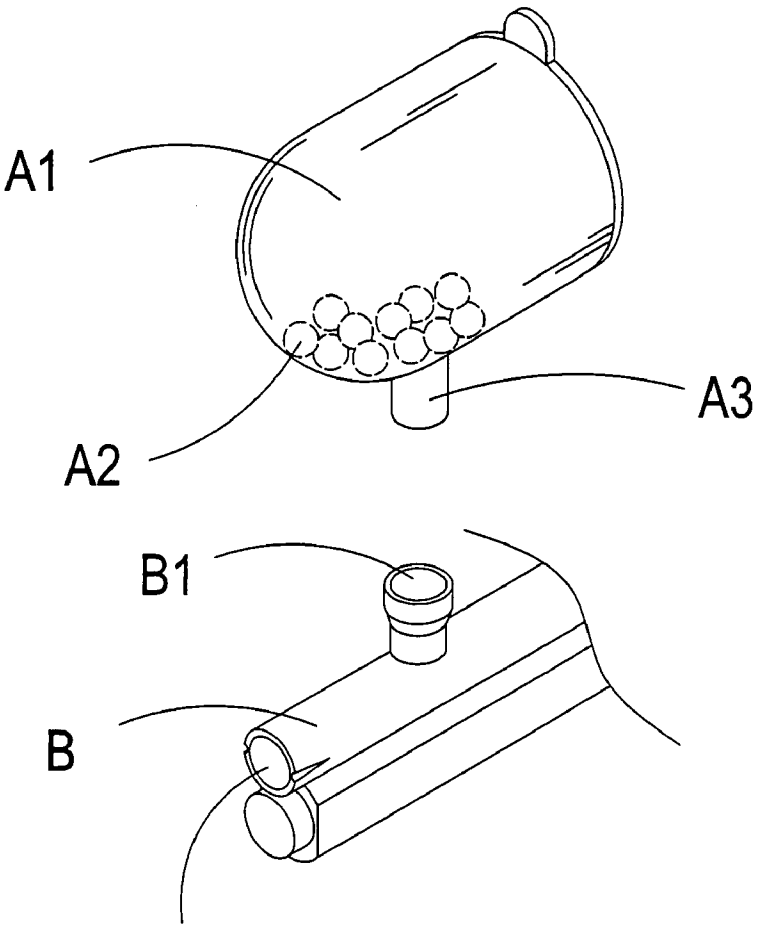
FIG. 2 Prior Art
FIG. 2 shows a cutaway view of a conventional paintgun hopper.
Figure 3:
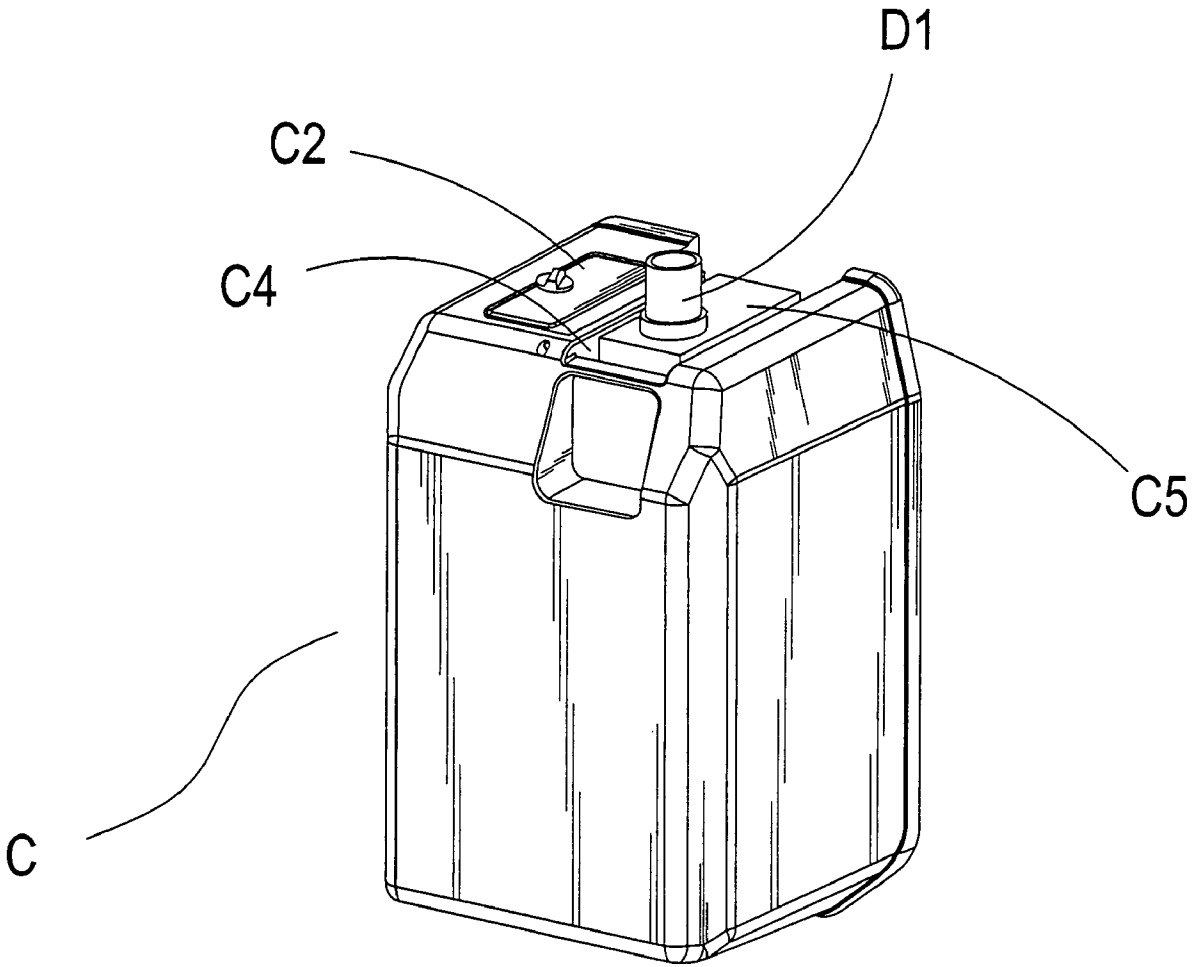
FIG. 3 shows an elevational view according to the present invention.
Figure 4:
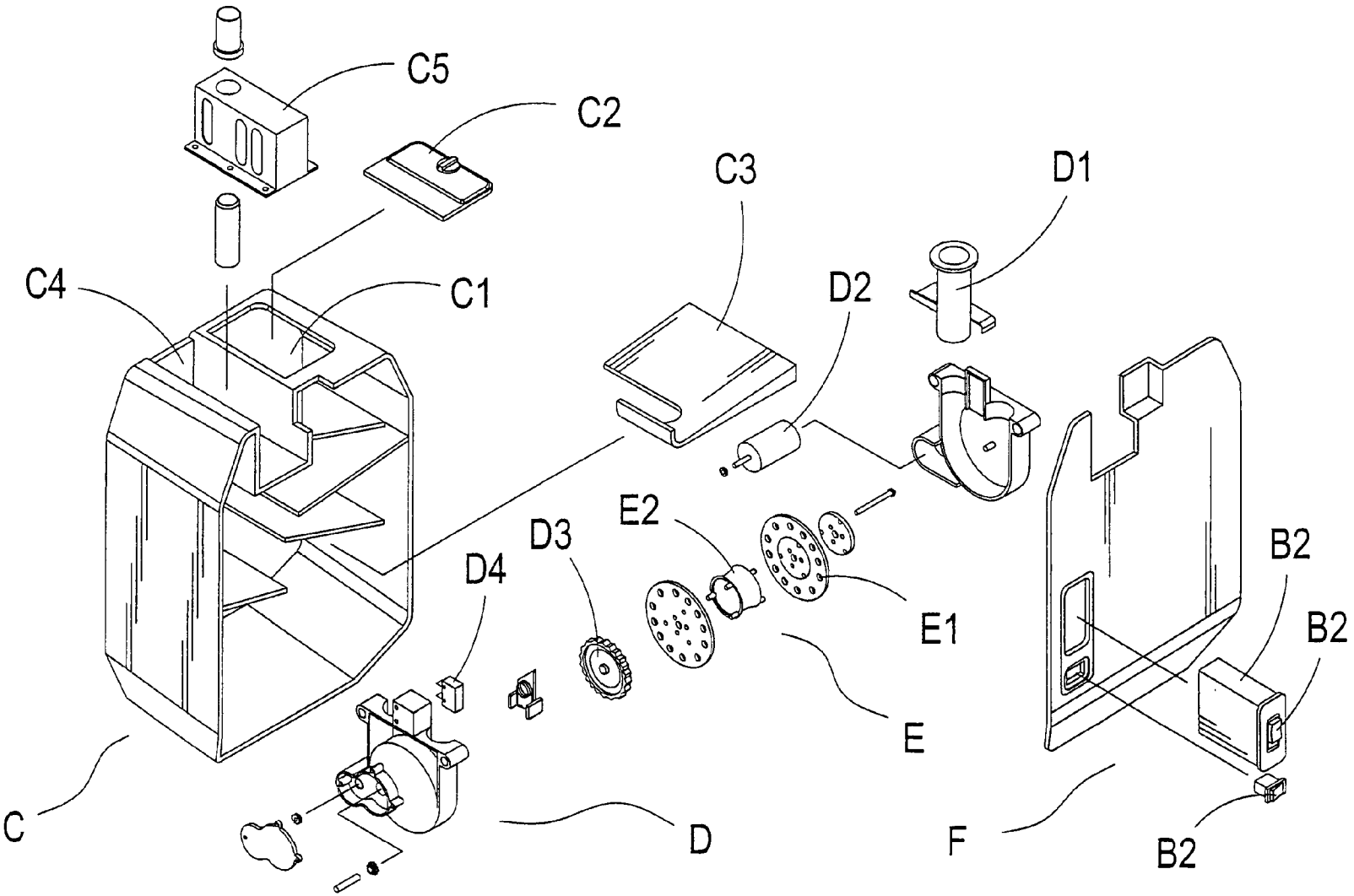
FIG. 4 shows an exploded elevational view according to the present invention.
Figure 7:
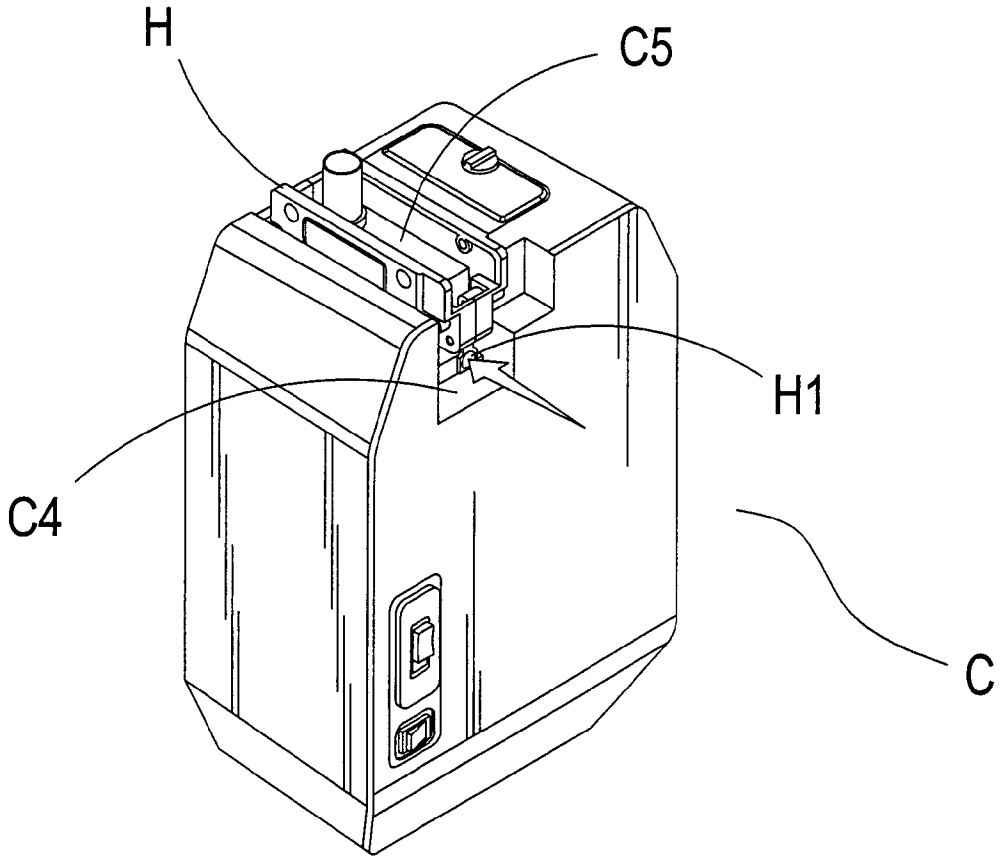
FIG. 7 shows an elevational schematic view of the embodiment according to the present invention (3).

Referring to FIGS. 3, 4 and 7, which show an electric paintball feed hopper for paintguns of the present invention, primarily structured to comprise a hopper C, a paintball feed mechanism D, a guide mechanism E and an electrical device F.

The present invention is characterized in having a hopper opening C1 defined in the hopper C, and a fastening cover C2, which prevents paintballs G from falling out, is fitted to the hopper opening C1. An oblique partition C3, which provides for sequencing of the paintballs G, is further configured on an inner side of the fastening cover C2. Moreover, the motor-driven paintball feed mechanism D and the guide mechanism E, which provides for successively feeding the paintballs G, are configured at a lower end of the oblique partition C3.

The paintball feed mechanism D is initiated by means of the guide mechanism E and a rotating motor actuated by the electrical device F, thereby providing an internal mechanism for successive feeding of the paintballs G. Moreover, the electrical device F is further configured with a battery compartment F1, a blocking switch F2 and a power switch F3. Uninterrupted firing of the paintballs G is achieved when the electrical device F is supplying electric power to actuate the paintball feed mechanism D, thereby achieving an effect that closely simulates the firing of a real gun.

The paintball feed mechanism D further comprises a paintball feed passageway D1, a rotating motor D2, a driving gear D3 and an interference switch D4. Moreover, a fixed shaft E2 functions in coordination with paintball guide holes E1 of the guide mechanism E to realize successive feeding of the paintballs G. Furthermore, the interference switch D4 is provided with functionality to prevent a complication of the paintballs G becoming jammed when sequencing of the paintballs G is hindered because of pressing down from the weight of the paintballs G.

Furthermore, a holding trough C4 is configured in the hopper C to hold an embed piece C5, which can be replaced with different shaped embed pieces to correspond to different shaped hopper troughs H. Moreover, the hopper trough H can be separated from the hopper C by means of a plug switch H1, thereby achieving functionality to enable a user to easily connect the different shaped hopper troughs H.

Figure 5:
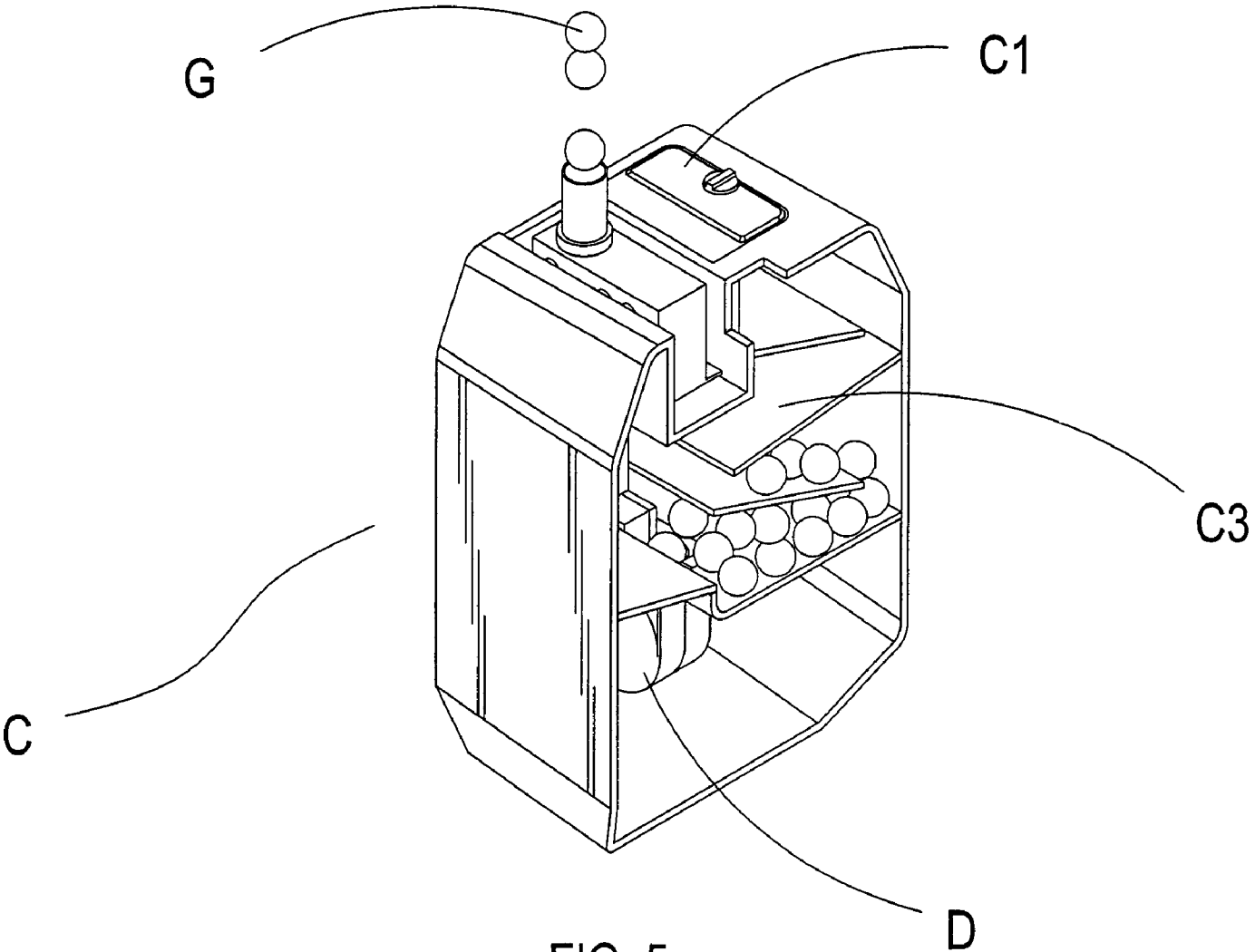
FIG. 5 shows a cutaway view of an embodiment according to the present invention (1).
Figure 6:
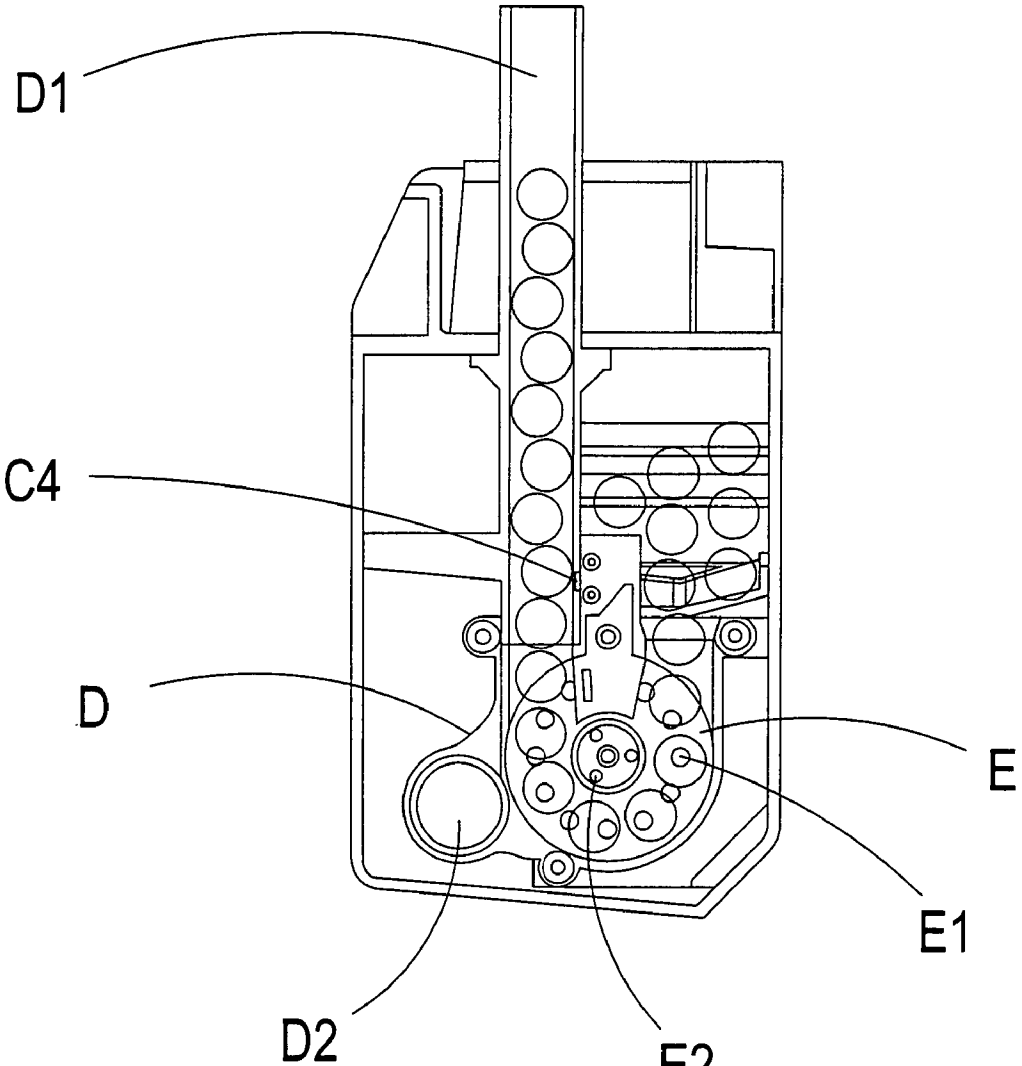
FIG. 6 shows a cross-sectional view of the embodiment according to the present invention (2).

Referring to FIGS. 4, 5 and 6, which show an embodiment of the present invention, wherein after a round of paintballs G is loaded into the hopper C through the fastening cover C1, the oblique partition C1 configured interior of the hopper C together with successive feeding of the paintballs G by the paintball feed mechanism D enable uninterrupted firing of the round of paintballs G loaded in the hopper C. Moreover, the paintball feed mechanism D correlates with rotating of the guide mechanism E, thereby achieving an effect that closely simulates the firing of a real gun.

Furthermore, the paintball feed mechanism D comprises the paintball feed passageway D1, the rotating motor D2, the driving gear D3 and the interference switch D4. Moreover, the fixed shaft E2 functions in coordination with the paintball guide holes E1 of the guide mechanism E to realize successive feeding of the paintballs G. Furthermore, the interference switch D4 is provided with functionality to prevent a complication of the paintballs G becoming jammed when sequencing of the paintballs G is hindered because of pressing down from the weight of the paintballs G.

The electrical device F is configured with the battery compartment F1 and the blocking switch F2. Batteries within the battery compartment F1 supply electric power to drive the rotating motor D2 that actuates the guide mechanism E. The electrical device F is further configured with the power switch F3, which facilitates providing the electrical device F with an operative power source. Moreover, such a configuration enables achieving uninterrupted shooting, thereby achieving an effect that closely simulates the firing of a real gun.

Figure 8:
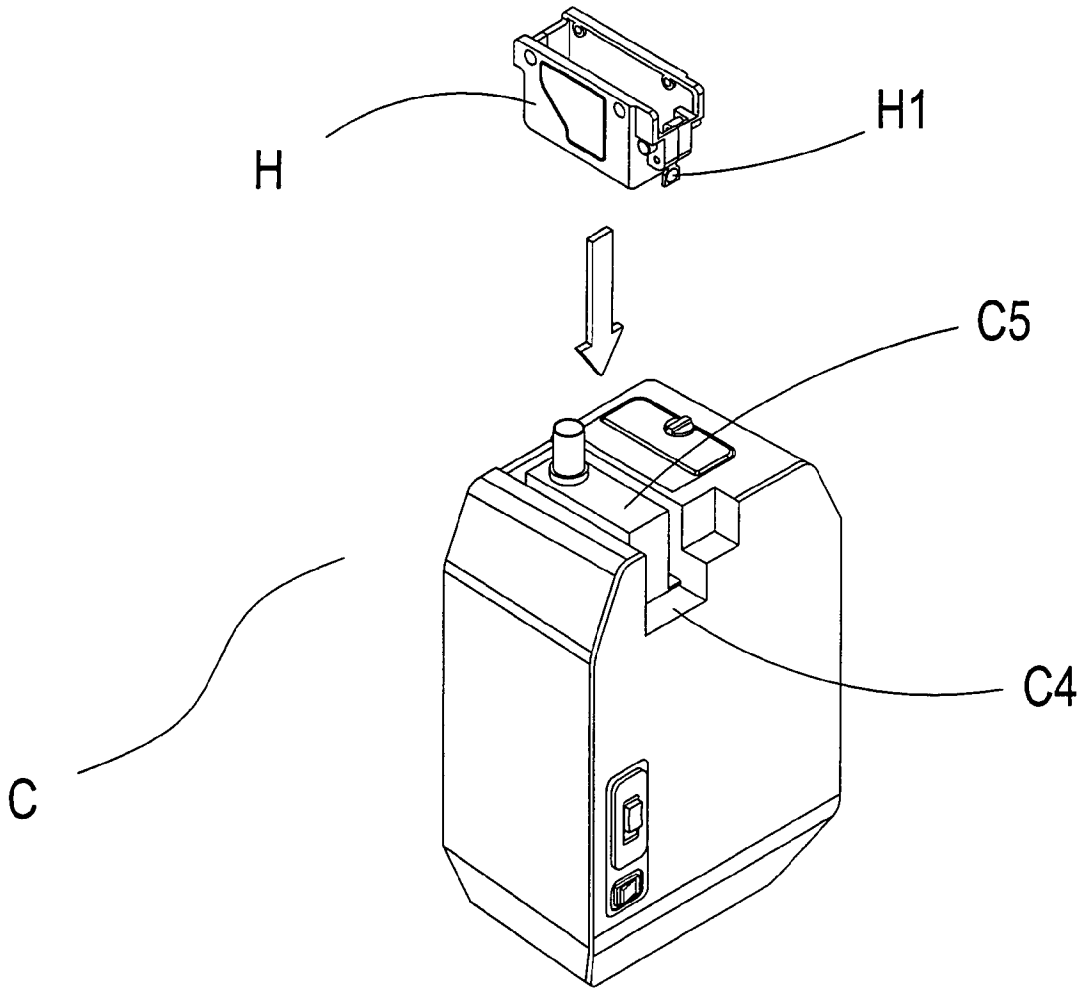
FIG. 8 shows an elevational schematic view of the embodiment according to the present invention (4).

Referring to FIGS. 7 and 8, the holding trough C4 is configured in the hopper C to hold the embed piece C5. When using the hopper C with different shaped hopper troughs, the embed piece C5 can be replaced with different shaped embed pieces to correspond to the different shaped hopper troughs. Moreover, the hopper trough H can be separated from the hopper C by means of the plug switch H1, thereby achieving functionality to enable a user to easily connect the different shaped hopper troughs H.

In order to better explicitly disclose advancement and practicability of the present invention, a comparison with conventional art is described hereinafter:

Shortcomings of Conventional Art

1. The hopper disposed on top of the barrel is unable to achieve an effect that simulates the firing of a real gun.

2. The paintball drop passageway connected to the hopper chamber easily results in jammed paintballs.

3. Unable to achieve an unhindered paintball feed process, thereby causing inconvenience in use.

4. Paintballs successively dropped into the paintball drop passageway easily result in jammed paintballs from the weight of the paintballs.

Advantages of the Present Invention

1. Use of an electrically driven paintball feed mechanism achieves an uninterrupted firing mechanism.

2. The hopper C and the paintball feed mechanism D achieve an effect that closely simulates the firing of a real gun.

3. The oblique partition C1 configured interior of the hopper C is able to achieve sequencing of the paintballs G.

4. The interference switch D4 prevents a complication of the paintballs G becoming jammed.

5. The embed piece C5 can be replaced to correspond to different shaped hopper troughs.

6. Provided with advancement and practicability.

7. Increased industrial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An electric paintball feed hopper for paintguns, characterized in having a hopper opening, which provides for loading paintballs, defined in a hopper, a fastening cover, which prevents the paintballs from falling out, is fitted to the hopper opening, and an oblique partition, which provides for sequencing of the paintballs, is further configured on an inner side of the fastening cover, moreover, a motor-driven paintball feed mechanism and a guide mechanism, which provides for successively feeding the paintballs, are configured at a lower end of the oblique partition;

the motor-driven paintball feed mechanism is actuated by an electrical device, the guide mechanism achieves object of successively feeding the paintballs, moreover, after a round of paintballs is loaded into the hopper, the paintball feed mechanism and the guide mechanism enable sequencing of the paintballs loaded within the hopper and successive shifting into a barrel of a paintgun, thereby achieving uninterrupted shooting and providing an effect that closely simulates the firing of a real gun;

a holding trough and an embed piece are configured in an end of the hopper in order for the hopper to accommodate different shaped hopper troughs, the embed piece can be replaced with different shaped embed pieces to correspond to the different shaped hopper troughs and enable convenient connection thereto.

2. The electric paintball feed hopper for paintguns according to claim 1, wherein the paintball feed mechanism comprises a paintball feed passageway, a rotating motor, a driving gear and an interference switch, which is provided with functionality to prevent the paintballs becoming jammed in the paintball feed passageway when sequencing and shifting of the paintballs by the guide mechanism is hindered because of pressing down from the weight of the paintballs.

3. The electric paintball feed hopper for paintguns according to claim 1, wherein the guide mechanism is configured with paintball guide holes and a fixed shaft, moreover, the rotating motor and the driving gear enable the paintball feed passageway of the paintball feed mechanism to successively feed the paintballs, thereby enabling the guide mechanism to achieve the object of good alignment of rotating movement.

4. The electric paintball feed hopper for paintguns according to claim 1, wherein the electrical device is configured with the battery compartment and a blocking switch, the battery compartment provides for batteries to be disposed therein, which supply electric power to drive the rotating motor and actuate the guide mechanism; the electrical device is further configured with a power switch, which provides the electrical device with power saving functionality.

* * * * *